US008596518B2

(12) United States Patent
Babcock

(10) Patent No.: US 8,596,518 B2
(45) Date of Patent: Dec. 3, 2013

(54) CARTON WITH REINFORCED HAND HOLES

(75) Inventor: Kenneth R. Babcock, Long Beach, CA (US)

(73) Assignee: Paige Electric Company, L.P., Union, NJ (US)

( * ) Notice: Subject to any disclaimer, the term of this patent is extended or adjusted under 35 U.S.C. 154(b) by 858 days.

(21) Appl. No.: 12/635,184

(22) Filed: Dec. 10, 2009

(65) Prior Publication Data

US 2011/0139863 A1 Jun. 16, 2011

(51) Int. Cl.
*B65D 5/468* (2006.01)

(52) U.S. Cl.
USPC ..... 229/117.16; 229/117.17; 229/199

(58) Field of Classification Search
USPC ..... 229/117.13, 117.16, 117.17, 163, 199; 206/424
See application file for complete search history.

(56) References Cited

U.S. PATENT DOCUMENTS

| | | | | | |
|---|---|---|---|---|---|
| 2,284,385 | A | * | 5/1942 | Freshwaters | 229/117.16 |
| 2,324,905 | A | * | 7/1943 | Chambliss | 229/117.17 |
| 2,961,143 | A | * | 11/1960 | Forrer | 229/117.17 |
| 3,048,318 | A | * | 8/1962 | Sabin | 229/120.38 |
| 3,927,822 | A | * | 12/1975 | Giebel | 229/117.17 |
| 4,447,004 | A | | 5/1984 | House et al. | |
| 4,842,189 | A | * | 6/1989 | Czosnyka | 229/117.16 |
| 5,584,430 | A | * | 12/1996 | Mulry | 229/117.16 |
| 5,873,516 | A | * | 2/1999 | Boggs | 229/117.13 |
| 5,887,782 | A | * | 3/1999 | Mueller | 229/199 |
| 6,619,540 | B1 | * | 9/2003 | Bazany | 229/199 |
| 6,766,940 | B2 | | 7/2004 | Negelen | |
| 7,472,791 | B2 | | 1/2009 | Spivey, Sr. | |
| 2007/0108261 | A1 | * | 5/2007 | Schuster | 229/117.16 |
| 2008/0257944 | A1 | * | 10/2008 | Blin | 229/117.13 |
| 2011/0049228 | A1 | * | 3/2011 | Brand | 229/117.13 |

FOREIGN PATENT DOCUMENTS

| | | | | |
|---|---|---|---|---|
| EP | 342029 | A1 * | 11/1989 | 229/117.16 |

* cited by examiner

*Primary Examiner* — Gary Elkins
(74) *Attorney, Agent, or Firm* — Cook Alex Ltd.

(57) ABSTRACT

A carton has a lifting panel, at least one alternate lifting panel, side, front and rear panels that collectively define an interior space for receiving a heavy weight of non-reel coil of filamentary material or coil products such as wire. The panels may include three hand holes, two of which are reinforced by two adapters insertable into the interior space. One form of adapter is assembled from a blank of foldable material and has top, front, bottom and back walls reinforced by gusset plates which are located remotely from the side edges of the top and bottom walls. The maximum width of the adapter top and bottom walls is less than the distance between opposed side panels of the carton. First and second retention members are formed in the panels and extend into the interior space of the carton where they are engageable with the adapters to support them adjacent a hand hole.

26 Claims, 14 Drawing Sheets

CARTON WITH REINFORCED HAND HOLES

BACKGROUND OF THE INVENTION

The advantages of non-reel cartons for packaging filamentary materials such as wire, cable and rope are set forth in U.S. patent application Ser. No. 11/675,755, filed Feb. 16, 2007, the disclosure of which is incorporated herein by reference. The present disclosure concerns cartons for holding filamentary materials that are capable of receiving a heavy weight of filamentary material such as wire. By way of example, the carton of the present disclosure is capable of carrying over 100 pounds of wire. Previous non-reel cartons typically were limited to carrying 15 to 20 pounds of wire. The additional capacity of the present carton enables the non-reel carton to replace the larger sizes of wooden reels that were used to package wire. This affords significant cost savings as well as environmental benefits since the cardboard carton is fully recyclable, unlike the standard wooden reel it replaces.

One of the challenges of a heavy weight carton is providing a way to carry it. It is not reasonable to expect a user to carry a full heavy weight carton weighing 100 pounds in one hand. Dual hand holes have to be provided. The hand holes have to be strong enough to prevent them from tearing out under load, which could possibly cause injury to the end user.

SUMMARY OF THE INVENTION

The present invention concerns a carton for carrying or packaging wire, cable or other filamentary material. The carton has a series of panels including at least one lifting panel, an alternate lifting panel, side panels and front and rear panels. The panels each have interior and exterior surfaces and collectively they define an interior space which receives the filamentary material.

In one embodiment of the invention first and second primary hand holes are formed in the lifting panels. Both hand holes may be in one lifting panel or they may be in separate lifting panels. Each primary hand hole defines in its panel a rim and a grasping zone adjacent the hand hole. The grasping zone is the area of the lifting panel that is opposite a user's fingers when a user places his or her fingers through the primary hand hole into the interior space and wraps the fingers about the rim of the primary hand hole such that the fingers are facing or opposite the interior surface of the panel in which the primary hand hole is formed.

In one aspect of the present disclosure, first and second adapters for reinforcing at least a portion of the grasping zones are placed adjacent the first and second primary hand holes, respectively. Each adapter has a mating plate which, when the adapter is installed, extends in a plane parallel to the interior surface of the lifting panel and is adjacent at least a portion of the grasping zone of the primary hand hole. At least one first retention member is formed in one of the panels and extends into the interior space where it is engageable with the first adapter to support it adjacent the first primary hand hole. At least one second retention member performs a similar function for the second adapter.

Another embodiment of this disclosure is similar to that just described with the addition of a third primary hand hole formed in the alternate lifting panel. This affords a user the option of placing the two adapters in any of three positions so the user can select where he or she wants the reinforced hand holes to be located. This is desirable because some users prefer to have two hand holes on the top of the carton and others prefer to have one hand hole on top and one hand hole on the bottom of the carton. With the selectably locatable adapters, all users get to have their preference met. Alternately, a fourth hand hole could be included and the two adapters could be placed in any of the four positions, creating an even more stable lift which further prevents the possibility of injury.

In another aspect of the present disclosure all of the lifting panels have edges to which side panels are attached. An adapter for reinforcing the grasping zone adjacent a hand hole has a maximum width less than the distance between the side panels. This allows installation of the adapter through the open front of the carton, after all the other panels have been assembled.

Still another aspect of the present disclosure concerns the adapter structure. It has a mating wall engageable with a panel of a carton. A back wall is connected to the mating wall. A bottom wall is connected to the back wall. The mating and bottom walls have side edges which define a maximum width of the adapter. At least one gusset plate extends from one of the mating and bottom walls toward the other, the gusset plate being spaced from the side edges of the wall that defines the maximum width of the adapter. The inwardly spaced gusset plates provide a stronger structure that can withstand the weight of the coil.

BRIEF DESCRIPTION OF THE DRAWINGS

FIG. 23 is a perspective view of the partially assembled carton of FIG. 22, showing the front and rear flaps folded in.

FIG. 24 is a perspective view similar to FIG. 23, showing the front and rear interior panels folded in.

FIG. 25 is a perspective view similar to FIG. 24, showing the front and rear exterior panels folded in.

DETAILED DESCRIPTION OF THE INVENTION

Figure 1:
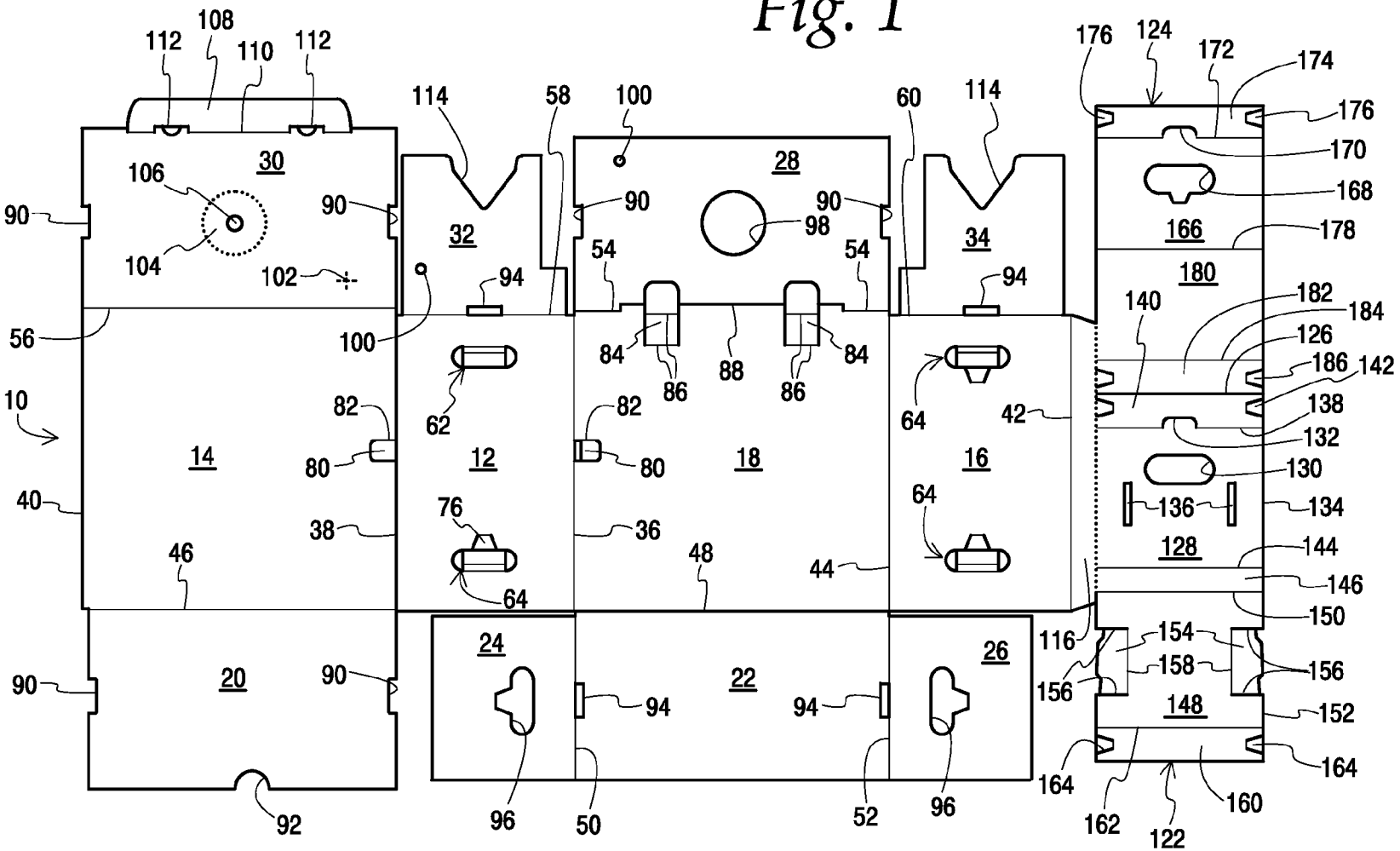
FIG. 1 is a plan view of a carton blank, which also includes a separable portion defining first and second adapter blanks.

FIG. 1 illustrates a carton blank 10 for the carton of the present invention. The carton is preferably made of heavy weight stock material, such as double wall corrugated cardboard. Other materials could be used, such as corrugated plastic. Preferably the corrugations run vertically as seen in FIG. 1. The blank shows the carton at one stage of its manufacture wherein it is completely flat. This stage is prior to subsequent stages which include: forming a joint between two of the panels; removing the adapter blanks; setting up the carton and adapters; and assembly of the carton including installation of the adapters. In FIG. 1 the interior lines of lighter weight indicate fold lines. Heavier lines indicate portions that are fully cut through the stock. Dotted lines indicate perforations. Also, portions of the carton will be designated herein as top, bottom, left, right, front and rear. It will be understood that these designations are for reference purposes only and the carton could be oriented in any manner that meets a user's needs. Left and right are designated from the viewpoint of an observer looking at the front panel, i.e., the panel having the large opening for a wire payout tube.

The carton includes a plurality of panels. Each panel has an interior surface and an exterior surface. In FIG. 1 the exterior surface is visible. In the illustrated embodiment when the panels are assembled they form a six-sided enclosure. Four of these sides are formed by a top panel 12, a right side panel 14, a bottom panel 16 and a left side panel 18. The rear of the carton is formed by two panels and two flaps. There is a rear interior panel 20 and a so-called turkey tail, which includes a turkey tail panel 22 and upper and lower turkey tail flaps 24, 26, respectively. The front of the carton is also formed by two panels and two flaps. There is a front interior panel 28, a front exterior panel 30, and upper and lower front V-notch flaps 32, 34, respectively.

The panels are bounded by edges which in some cases are defined by fold lines which join some of the panels together. The top panel 12 has edges defined by an upper primary fold line 36 and an upper secondary fold line 38. The right side panel 14 has edges defined by the upper secondary fold line 38 and a lower border 40. The lower border 40 is not a fold line; it is just the terminus of the blank. The bottom panel 16 has edges defined by a lower primary fold line 42 and a lower secondary fold line 44. The left side panel 18 has edges defined by the lower secondary fold 44 and the upper primary fold 36.

Except for the turkey tail flaps 24, 26, the panels forming the front and rear portions of the carton are similarly joined to the top, bottom or side panels by fold lines. Thus, rear interior panel 20 is joined to the right side panel 14 by its fold line 46. The turkey tail panel 22 is joined to the left side panel 18 by its fold line 48. The upper turkey tail flap 24 is joined to the turkey tail flap 22 by fold line 50 while the lower turkey tail flap 26 is joined to the turkey tail flap 22 by fold line 52. At the front of the carton the front interior panel 28 is joined to the left side panel 18 by a pair of fold lines forming hinges 54. The front exterior panel 30 is joined to the right side panel 14 by its fold line 56. The upper front V-notch flap 32 is joined to the top panel 12 by fold line 58 and the lower front V-notch flap 34 is joined to the bottom panel 16 by fold line 60.

Each of the panels has certain structural details that will now be described, beginning with the top panel 12. First and second primary hand holes 62 and 64 are formed in the top panel. These are openings or apertures through the panel. Details of the hand holes are more easily seen in the full-sized enlargement shown in FIG. 1A. The solid lines in this figure represent slits cut fully through the material while the dashed lines represent fold lines. Thus, the semi-circular portions designated X are cut out entirely during manufacture of the blank and these portions are empty in the finished blank. In the illustrated embodiment the hand holes 62, 64 have a rectangular central portion with rounded ends, but the shape could be otherwise. The hand holes are sized to permit a user to insert at least the four fingers of his or her hand into the hand hole to enable the user to grasp the carton and lift, carry or move it. For reference purposes only and not by way of limitation, the opening may be about four inches long and an inch and a quarter wide.

Each primary hand hole 62, 64 defines in its panel a rim 66. In the illustrated embodiment the rim includes a fully cut portion and a double fold line. The fully cut portion includes a straight slit 68A and two curved end slits 68B. The double fold line includes fold line 70A and fold line 70B. The straight slit 68A and fold lines 70A, B define a rectangular finger cushion 72. Once the carton has been assembled the finger cushion 72 is pushed through the hand hole and into the interior space of the carton. During this process the finger cushion is folded once about line 70A to place the cushion perpendicular to the panel, and then a second time about fold line 70B to tuck the majority of the finger cushion back under the panel. Thus, the majority of the finger cushion 72 ends up inside the carton (and inside an adaptor's mating panel as will be explained below) parallel to the panel in which it is formed.

The rim 66 defines a grasping zone 74 adjacent the hand hole 62 or 64. The grasping zone 74 is that portion of the panel which may be opposite a user's fingers when a user extends his or her fingers through the primary hand hole into the interior space and wraps the fingers about the rim of the primary hand hole to face the interior surface of the panel in which the primary hand hole is formed. Note the user's fingers will not actually contact the interior surface of the panel due to the presence of intervening members, such as the finger cushion 72, or the adaptor's mating plate to be described below, or one of the turkey tail flaps 24, 26. Also, the hand holes are located sufficiently remote from any adjacent panel such that the grasping zone 74 is large enough on all sides of the rim 66 to accommodate a user's fingers at least up to the second knuckle. Thus, for example, the fold line 70A of hand hole 62 is spaced far enough from fold line 58 of the upper front V-notch flap 32 that there is a grasping zone 74 between fold lines 70A and 58 large enough such that a user's fingers at least from the second knuckle to the tips of the fingers will fit onto that grasping zone. This size of grasping zone is provided for comfort and safety of the user.

Note also that while the grasping zone 74 is that portion of the panel opposite which the user's fingers may end up, depending on the structure of the adapter, it may or may not be feasible to lift the carton by all portions of the grasping zone. That is, the adapter may be structured to reinforce only a portion of the grasping zone, in which case the unreinforced portions of the grasping zone should not be used to transport the carton. While it will become evident below that in the embodiments illustrated herein the adapters' mating plates support the entire grasping zone and thus make the entire grasping zone suitable for transporting the carton, it is possible to use only a portion of a grasping zone for transport. For example, if an adaptor only reinforces the portion of the grasping zone adjacent the fold lines 70, a user would be instructed not to wrap his or her fingers about the straight slit portion 68A because lifting on this unreinforced section of the grasping zone could cause the panel to tear out.

Due to the presence of at least one hand hole 62 or 64, the top panel 12 can be designated a lifting panel. That is, a user can grasp one of the hand holes for purposes of transporting the carton.

Figure 1A:
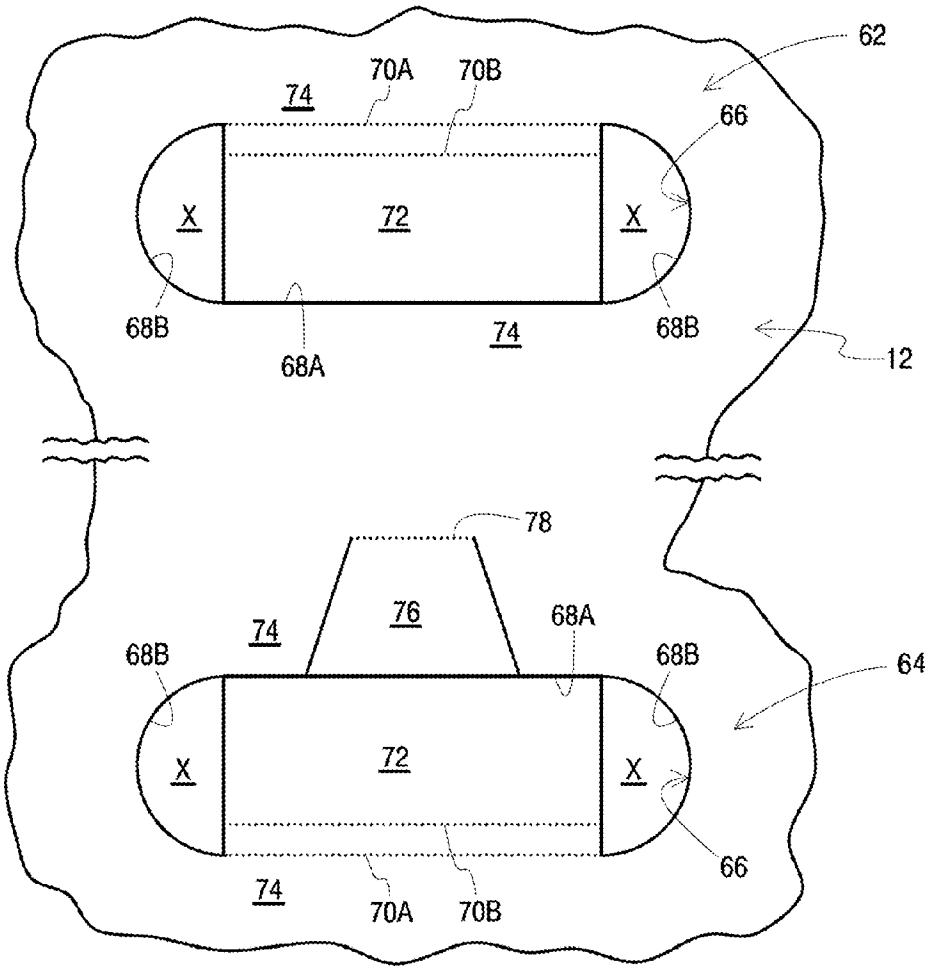
FIG. 1A is a plan view, on an enlarged scale, of the top panel portion of FIG. 1, showing details of the first and second primary hand holes.

Continuing now with FIG. 1A, the second primary hand hole further includes a second retention member 76. The second retention member is a tab in the top panel 12 that can be folded into the interior space of the carton about the fold line 78. As will be explained below, in so doing the second retention member may engage a second adapter and hold it in place. While the second retention member 76 is shown as having a trapezoidal shape, its shape could be otherwise.

Returning now to FIG. 1, we will continue the consideration of the details in the panels by examining the right side panel 14. It has a first retention member 80 adjoining the upper secondary fold line 38. The first retention member has slits on three sides and a fold line 82 on its fourth side. As such the first retention member can be folded into the interior space of the carton about the fold line 82. As will be explained below, in so doing the first retention member may engage a first adapter and hold it in place. While the first retention member 80 is shown as having a rectangular shape, its shape could be otherwise. Folding the first retention member inwardly also provides an aperture in the right side panel for receiving a shaft on which the carton may be mounted, as described in the above-reference patent application. This aperture may also be used to receive a rod for securing the carton to a certain location, for example, on a transporter cart.

It will be understood that while the general arrangement of the first and second retention members as shown is preferred because the retention members are integrally formed in the carton and require no additional parts, the retention members could have alternate configurations from those shown. The retention members could be in the nature of bolts or rods inserted from the outside of the carton and extending partially or fully across the carton to the opposite panel. Or one of the retention members could constitute a shelf-like member connectable to one panel and extending across the carton for attachment to the opposite panel, thereby forming a slot for receiving an adapter between the shelf-like member and the associated lifting panel. Alternately, the retention member could rest on the panel opposite the lifting panel and extend toward the lifting panel but stop short thereof to leave a space between the retention member and the lifting panel for receiving the adapter. For example, two sheets of cardboard could rest on the interior surface of the bottom panel 16, one sheet against the interior surface of each side panel and parallel to the side panel. The top edges of the sheets would lie below the interior surface of the top panel by an amount equal to the thickness of the adapter. The adapter would slide in under the top panel but above the support sheets and the side edges of the adapter would rest on the top edges of the sheets. Instead of full sheets one or more elongated legs of similar height could be arranged against the side edges to support an adapter on top thereof.

Turning now to the bottom panel 16, it has two second primary hand holes 64 that are the same as the second primary hand hole 64 in the top panel as described above. The presence of at least one hand hole means the bottom panel can be designated an alternate lifting panel. Thus, depending on where a user chooses to place the second adapter, the bottom panel 16 may be used to grasp the carton and transport it. Although the top and bottom panels 12 and 16 are shown as having hand holes, it will be understood that the hand holes could be placed in other panels or additional panels. If additional panels were provided with hand holes, such additional panels would become alternate lifting panels as well.

Looking next at the left side panel 18 details, it has a first retention member 80 with a fold line 82, similar to that of the right side panel. This retention member serves the same purpose of holding a first adaptor in place and defining an aperture for a mounting shaft. The left side panel 18 also has two retainer tabs 84 defined by a U-shaped slit. Each retainer tab has two fold lines 86 that allow the tabs to be tucked into the front exterior panel as will be explained below. Extending between the retainer tabs, and slightly beyond them, is a retainer flap slit 88. This receives a retainer flap on the front exterior panel 30.

The rear interior panel 20 has a pair of tongue notches 90 on what will become its top and bottom edges. These may receive a tongue on the front of a second adaptor. The free, eventually vertical edge of the rear interior panel 20 has a semi-circular cutout 92. The cutout provides a convenient finger hold that assists in expanding the panel from its stowed position to its assembled position in the turkey tail. The turkey tail panel 22 has a pair of tongue slots 94 adjacent fold lines 50, 52. The tongue slots 94 may receive a tongue of a second adaptor. The upper and lower turkey tail flaps 24, 26 each have a pass-through hole 96. This hole is shaped like the perimeter of the second primary hand hole 64, but there is no finger cushion nor is there a retention member. The pass-through holes 96 will end up aligned with two of the hand holes 64 in the top and bottom panels.

Looking now at the front panel details, front interior panel 28 has a pair of tongue notches 90. It also has a circular payout tube opening 98. This opening receives a wire payout tube (not shown) in the conventional manner. There is also a small wire aperture 100. This aperture cooperates with a small cross-slit 102 in the front exterior panel 30 to permit excess wire extracted from the payout tube to be pushed back into the carton and held for later use.

Further details of the front exterior panel 30 include two tongue notches 90 and a payout tube knockout 104. The knockout is defined by perforated lines that allow the knockout to remain in place during shipment of a coil in a carton and prevent premature or unwanted dispensing. When a user is ready to dispense filamentary material such as wire he or she removes the knockout which permits the payout tube to be exposed in the resulting opening. A small hole 106 in the center of the knockout 104 assists in removal of the knockout at the appropriate time. What will become the vertical free edge of the front exterior panel has a retainer flap 108 attached thereto by a fold line 110. A pair of slots 112 interrupt the fold line. These receive the retainer tabs 84.

Rounding out the flap details, the upper and lower V-notch flaps 32, 34 each have a V-notch 114. These provide clearance for the payout tube. There is also a tongue slot 94 in each of the V-notch flaps.

The lower primary fold line 42 on the bottom panel 16 defines a relatively narrow connecting flap 116. This flap has a dual purpose. First, it is an attachment point for the adaptors along a perforated line 118. Second, it connects the bottom panel 16 to the right side panel 14. During manufacture of the carton, the blank is folded about the upper primary fold line 36. In the view of FIG. 1 panels 12 and 14 would be folded down, into the plane of the paper so they end up underneath panels 16 and 18. This places the lower border 40 of the right side panel 14 in alignment with the lower primary fold line 42. Connecting flap 116 is then folded around the lower border 40 and is glued to the external surface of the right side panel 14. The result can be seen in FIG. 2 (although this view is flipped over about a horizontal axis from that of FIG. 1). A portion of the connecting flap 116 is broken away in FIG. 2 to show the glue 120. Other fastening methods could be used to fix the connecting flap 116 to the right side panel 14.

Returning to FIG. 1, as just mentioned the connecting flap 116 provides an initial connecting point for the adapters. In this embodiment there are two adapters, a first adapter 122 and a second adapter 124. The two adapters are separated by a slit 126. The first adapter 122 includes a mating plate 128 that includes a secondary hand hole 130, a tongue 132, a pair of side edges 134 and a pair of gusset slots 136 that are spaced inwardly from the side edges 134. The mating plate 128 is joined at a front fold line 138 to an overlapping wall 140. The sides of the overlapping wall have retainer tabs formed 142 therein. The mating plate 128 is joined at a rear fold line 144 to a back wall 146. Back wall in turn joins bottom wall 148 at a fold line 150. The bottom wall has a pair of side edges 152. Two gusset plates 154 are formed in the bottom wall by lateral slits 156 and a fold line 158. The fold line 158 is spaced inwardly from the side edges 152. The side edges of one of the mating and bottom walls define a maximum width of the adapter 122. In this embodiment the side edges are aligned with one another so the width of the mating and bottom walls is the same. The adapter is completed by a front wall 160 attached to the bottom wall 148 at fold line 162. There are notches 164 at the sides of the front wall.

The placement of the gusset fold line 158 inwardly from the side edges of the adapter provides a stronger adapter because there is less unsupported expanse of the mating and bottom walls. The stronger adapter is necessary to support the greater weight of the coil of wire or other material. That is, an adapter may be placed on the bottom panel of the carton, underneath the coil. Or an adapter placed underneath the top panel may bear the weight of the coil if the carton is turned upside down during shipment or handling. Either way, the adapter has to be able to support the weight of the coil without getting crushed. The inwardly spaced gusset plates provide this capability.

The second adapter 124 includes a mating plate 166 having a secondary hand hole 168 therein. This secondary hand hole has shape that matches that of the second primary hand hole 64. There is a tongue 170 at the front of the mating plate 166. The mating plate is joined at a front fold line 172 to an overlapping wall 174. There are retainer tabs 176 in the sides of the overlapping wall 174. The mating plate 166 is joined at a vertex fold line 178 to a bottom wall 180. Bottom wall 180 joins a front wall 182 at fold line 184. There are notches 186 at the sides of the front wall.

Figure 2:
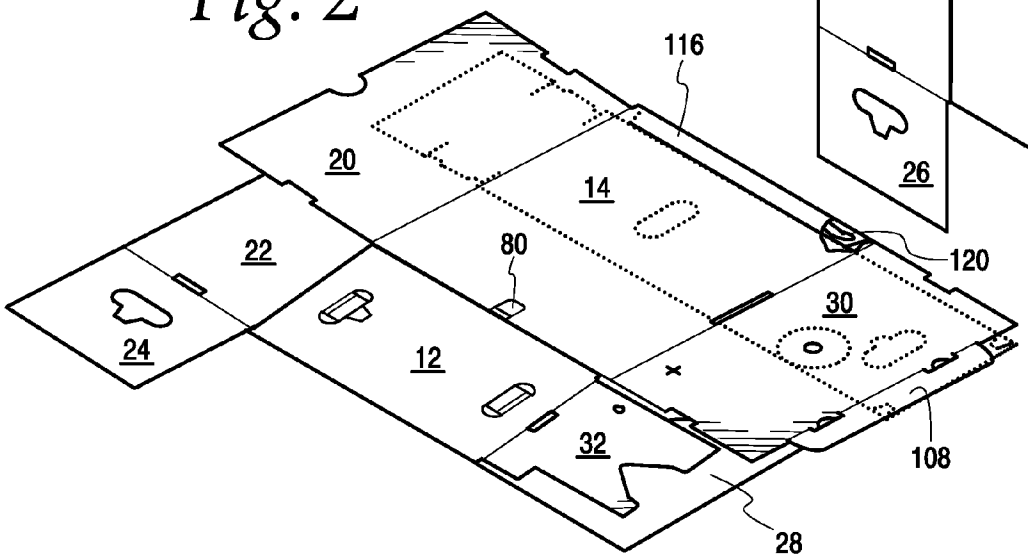
FIG. 2 is a perspective view of the knocked-down carton blank of FIG. 1 after being folded and glued, with the adapter blanks removed, ready for setup and assembly.

The carton is shipped from the carton manufacturer to a coil seller in the folded and glued condition of FIG. 2, although with the first and second adapters 122, 124 still attached to the connecting flap 116. The coil seller removes and sets up the adapters. The coil seller also sets up and assembles the carton, and installs the adapters and coil therein per his customer's order. The following will describe how this is done.

Figure 14:
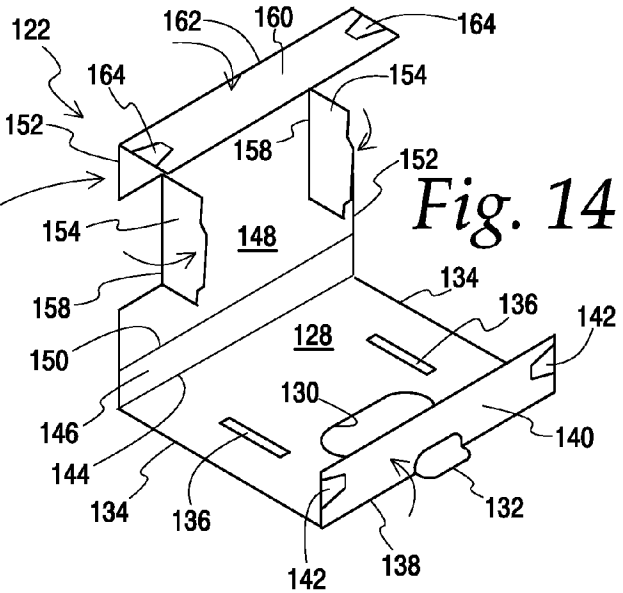
FIG. 14 is a diagrammatic perspective view of the adapter blank of FIG. 13 with the front and back walls folded into position, the overlapping wall folded, and the gusset plates folded.
Figure 13:
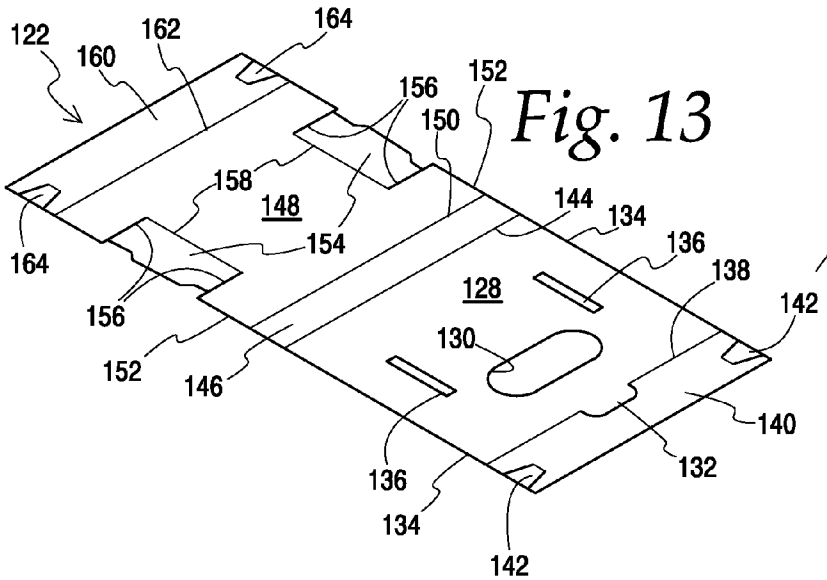
FIG. 13 is a diagrammatic perspective view of a blank for forming the first adapter.
Figure 15:
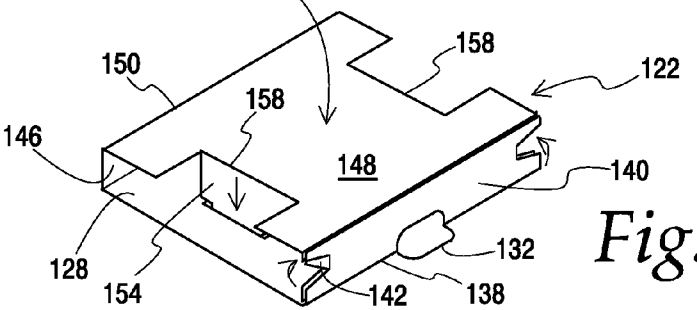
FIG. 15 is a diagrammatic perspective view of the adapter blank of FIG. 14 with the bottom wall folded into position and the retainer tabs of the overlapping wall turned into the notches of the front wall.
Figure 16:
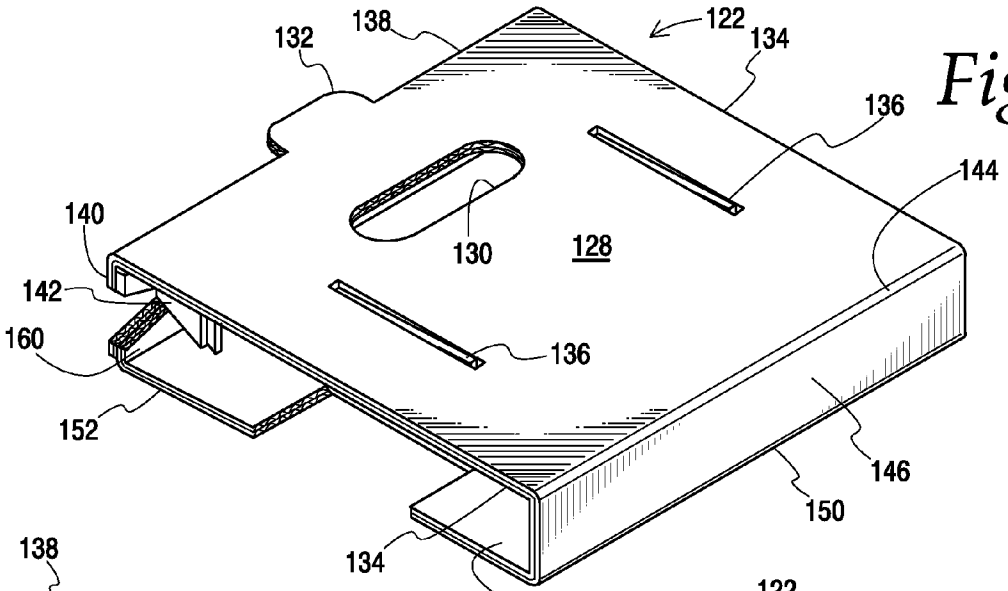
FIG. 16 is a perspective view of the assembled first adapter, looking primarily at the mating plate and back wall.
Figure 17:
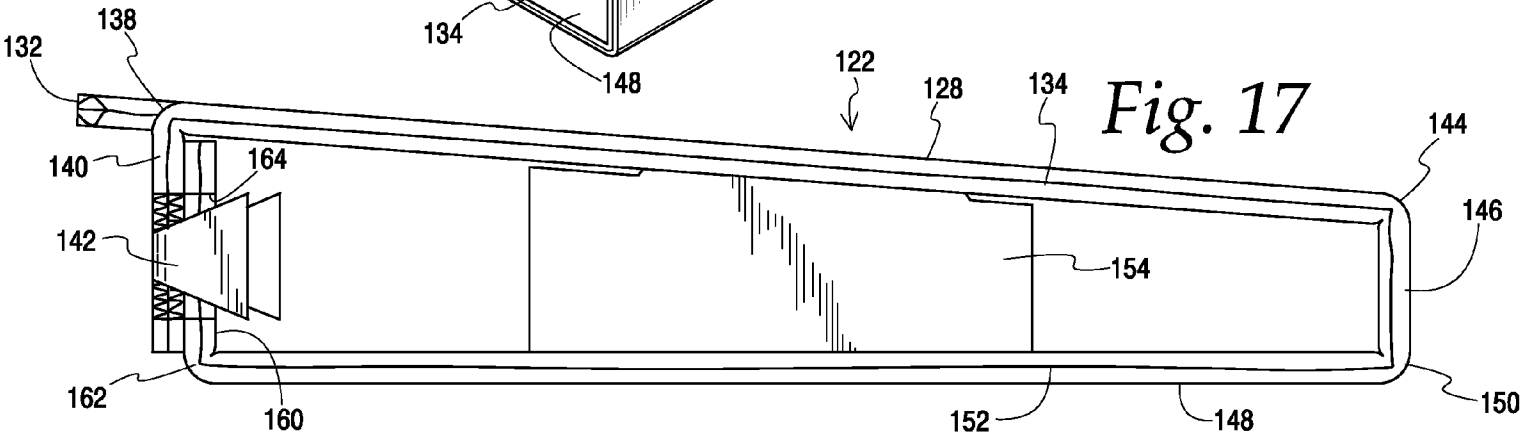
FIG. 17 is a side elevation view of the assembled first adapter with the gusset plates folded into position.

FIGS. 13-18 illustrate the setup of the first adapter 122. FIG. 13 shows the flat adapter blank after separation from the blank 10 along perforation line 118. In FIG. 14 the back wall 146 and bottom wall 148 are folded up 90° from the mating wall 128 about fold line 144. Also, gusset plates 154 are folded about fold line 158 and front wall 160 is folded about fold line 162. In addition, overlapping wall 140 is folded up about fold line 138. The next step is to fold down the bottom wall 148 about fold line 150. When this is done the gusset plates 154 fit into the gusset slots 136 in the mating plate 128. Also, the front wall 160 fits in behind the overlapping wall 140. Finally, the retainer tabs 142 in the overlapping wall are folded into the notches 164 of the front wall. This holds the adapter in the folded condition, ready for installation in a carton, as can be seen in FIGS. 16 and 17. It will also be noted that in its folded condition the bottom wall 148 acts as a shield, protecting a user's fingers as they protrude through the secondary hand hole 130 from any unseen hazards inside the container, e.g., damaged filamentary material.

Figure 18:
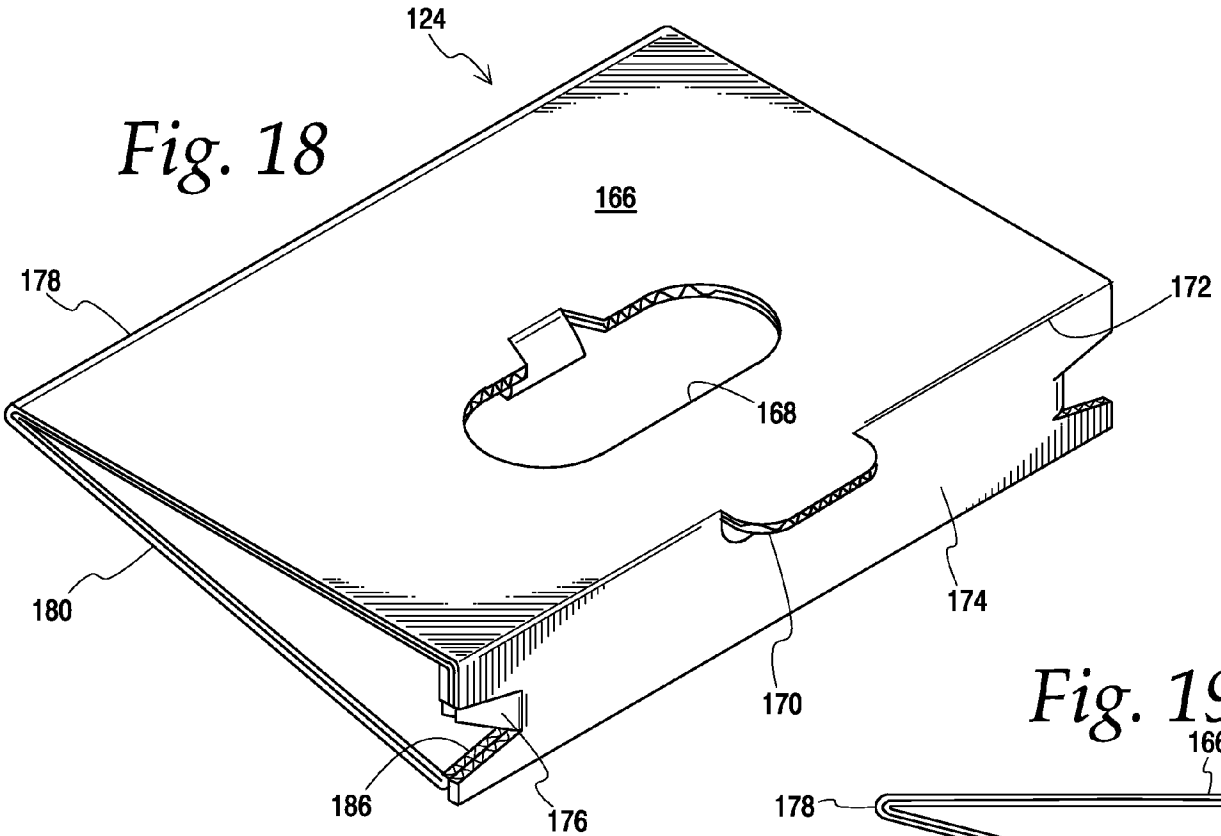
FIG. 18 is a perspective view of the assembled second adapter.
Figure 19:
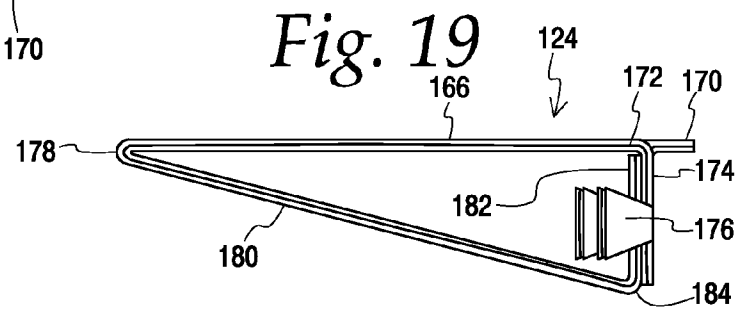
FIG. 19 is side elevation view of the second adapter.

FIGS. 18 and 19 show that a similar process is used to set up the second adapter 124. The difference with the second adapter is it does not have a back wall. The back wall is not needed to separate the mating plate 166 from bottom wall 180 because the second adapter is not going to receive a mounting shaft as does the first adapter. Removal of the back wall shortens the overall length of the second adapter blank so it fits within the confines of the box blank 10. The absence of a back wall gives the second adapter a triangular profile, as seen in FIG. 19. Also, in this embodiment the second adapter does not have gusset plates, although they could be included if desired. The second adapter does have a mating plate 166 and front and overlapping walls 182 and 174 that lock together by virtue of the retainer tabs 176 fitting into the notches 186.

Figure 3:
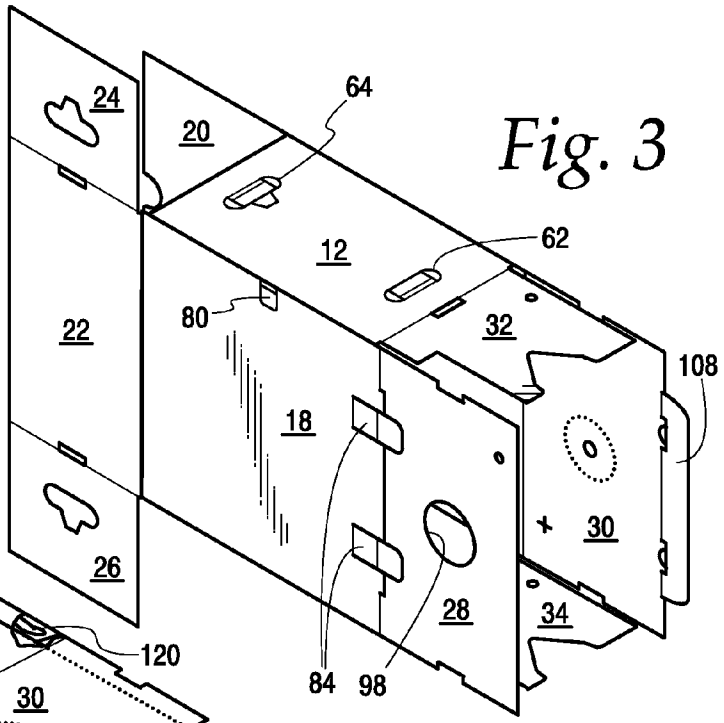
FIG. 3 is a perspective view of the setup carton, ready for assembly, with the front of the carton in the foreground.
Figure 5:
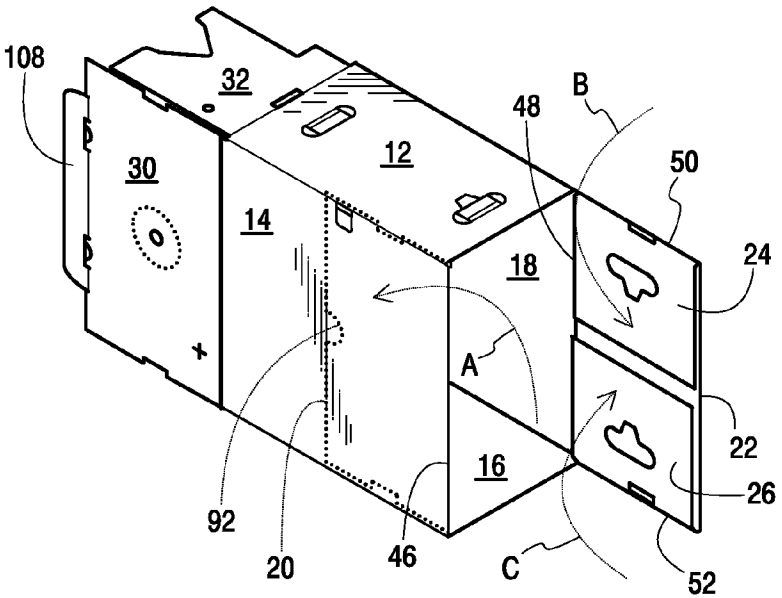
FIG. 5 is a perspective view of the partially assembled carton, with the rear of the carton in the foreground, and the rear interior panel stowed fully inside the carton and the turkey tail flaps stowed against turkey tail panel prior to closing that panel.
Figure 4:
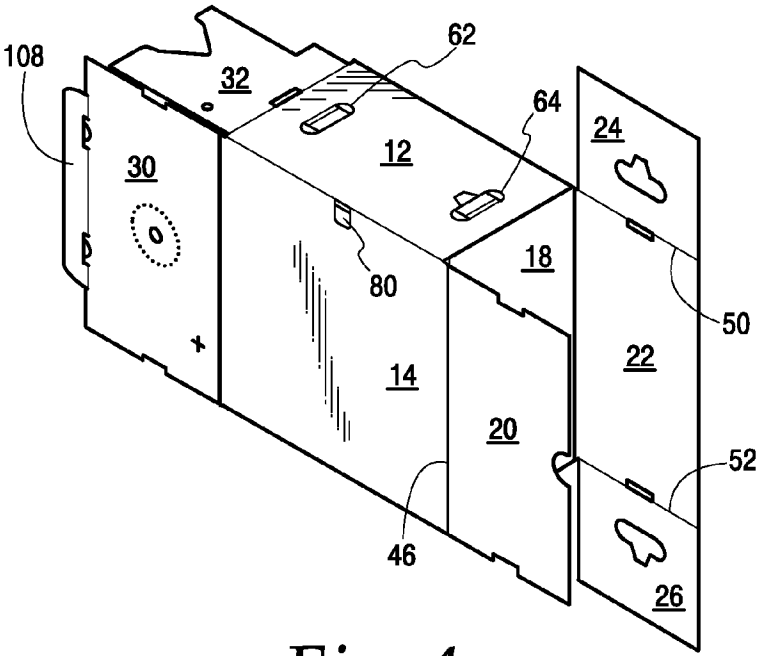
FIG. 4 is a perspective view of the setup carton, ready for assembly, with the rear of the carton in the foreground.
Figure 7:
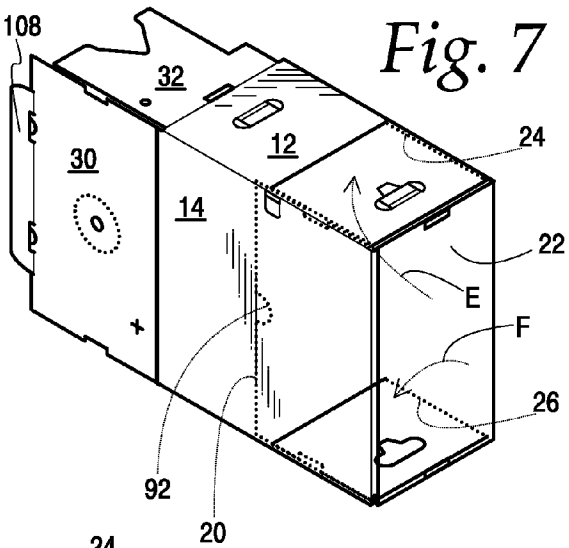
FIG. 7 is a perspective view similar to FIG. 6 showing the turkey tail flaps expanded to their assembled positions.
Figure 6:
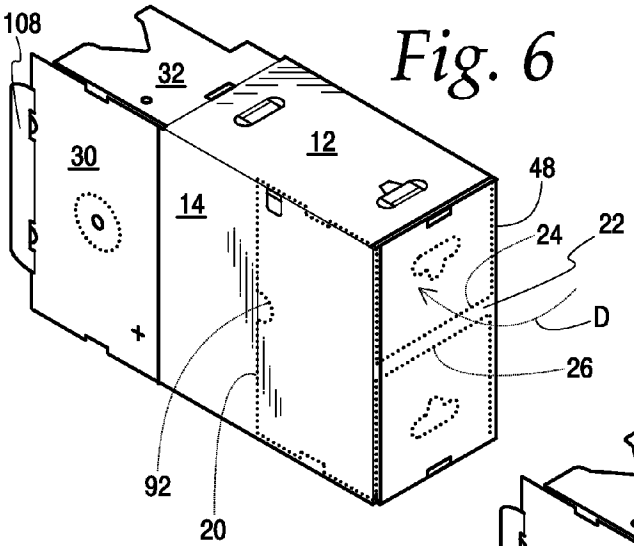
FIG. 6 is a perspective view similar to FIG. 5 showing the turkey tail panel closed.
Figure 8:
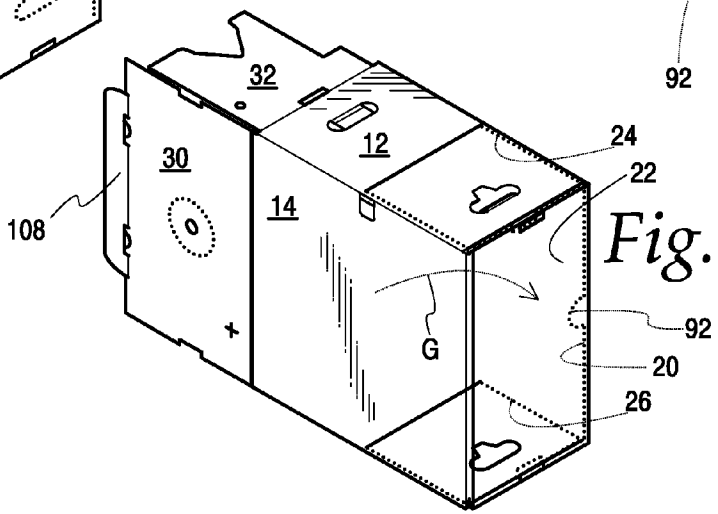
FIG. 8 is a perspective view similar to FIG. 7 showing the rear interior panel expanded to its assembled position inside the turkey tail.
Figure 10:
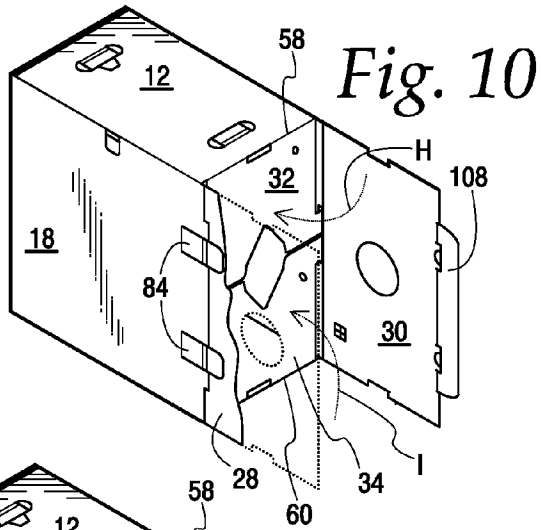
FIG. 10 is a perspective view similar to FIG. 9 showing the first steps for closing the front end, namely, folding in the front interior flaps.

With the adapters prepared, the coil seller is ready to set up and assemble the carton. Starting with the flattened box of FIG. 2, the side panels 14, 18 and top panel 12 are lifted to the condition of FIG. 3, forming a more or less four-sided structure. Then the rear side of the carton is closed, starting with the configuration as in FIG. 4. First, the rear interior panel 20 is stowed inside the carton by folding it in the direction of arrow A about fold line 46, as shown in FIG. 5. To stow the panel 20 it must be pushed in until it is nearly flush with the inside surface of right side panel 14. Second, the upper and lower turkey tail flaps 24, 26 are stowed against the inside surface of turkey tail panel 22 by folding in the direction of arrows B and C about fold lines 50 and 52, respectively. Third, the turkey tail panel 22 is closed by folding it 90° in the direction of arrow D about fold line 48, as shown in FIG. 6. Fourth, the assembler must expand the turkey tail flaps 24, 26 from their stowed positions by reaching in through the front of the carton to push the upper and lower turkey tail flaps against the inside surfaces of the top and bottom panels 12, 16, respectively, as shown by arrows E, F in FIG. 7. Fifth, again from the front of the carton the rear interior panel 20 must be expanded by pushing it toward the turkey tail panel 22, between the expanded turkey tail flaps 24, 26, as shown by arrow G in FIG. 8. This finishes the rear closure.

FIGS. 9-12 illustrate the procedure for closing the front of the carton. However, before the front is closed the adapters and the coil of filamentary material must be installed. If the selection has been made to reinforce both of the hand holes in the top panel 12, the second adapter 124 is installed through the open front of the carton, sliding it in between the side panels 14, 18. The maximum width of the second adapter is slightly less than the distance between the interior surfaces of the side panels, thus allowing the adapter to fit in readily. The mating plate 166 is placed in contact with the underside of the upper turkey tail flap 24. The secondary hand hole 168 is aligned with the pass-through hole 96 and the second primary hand hole 64. In this position the tongue 170 extends through the upper notch 90 of the rear interior panel 20 and into the upper tongue slot 94 of the turkey tail panel 22. But support at this point alone cannot assure the adapter will remain in place. The second retention member 76 in the top panel must be pushed down through the pass-through hole 96 and into the secondary hand hole 168 of the second adapter. This supports the second adaptor in two places and assures it remains in place where its mating plate 166 fully surrounds the rim 66 and reinforces the grasping zone of the second primary hand hole 64.

Figure 28:
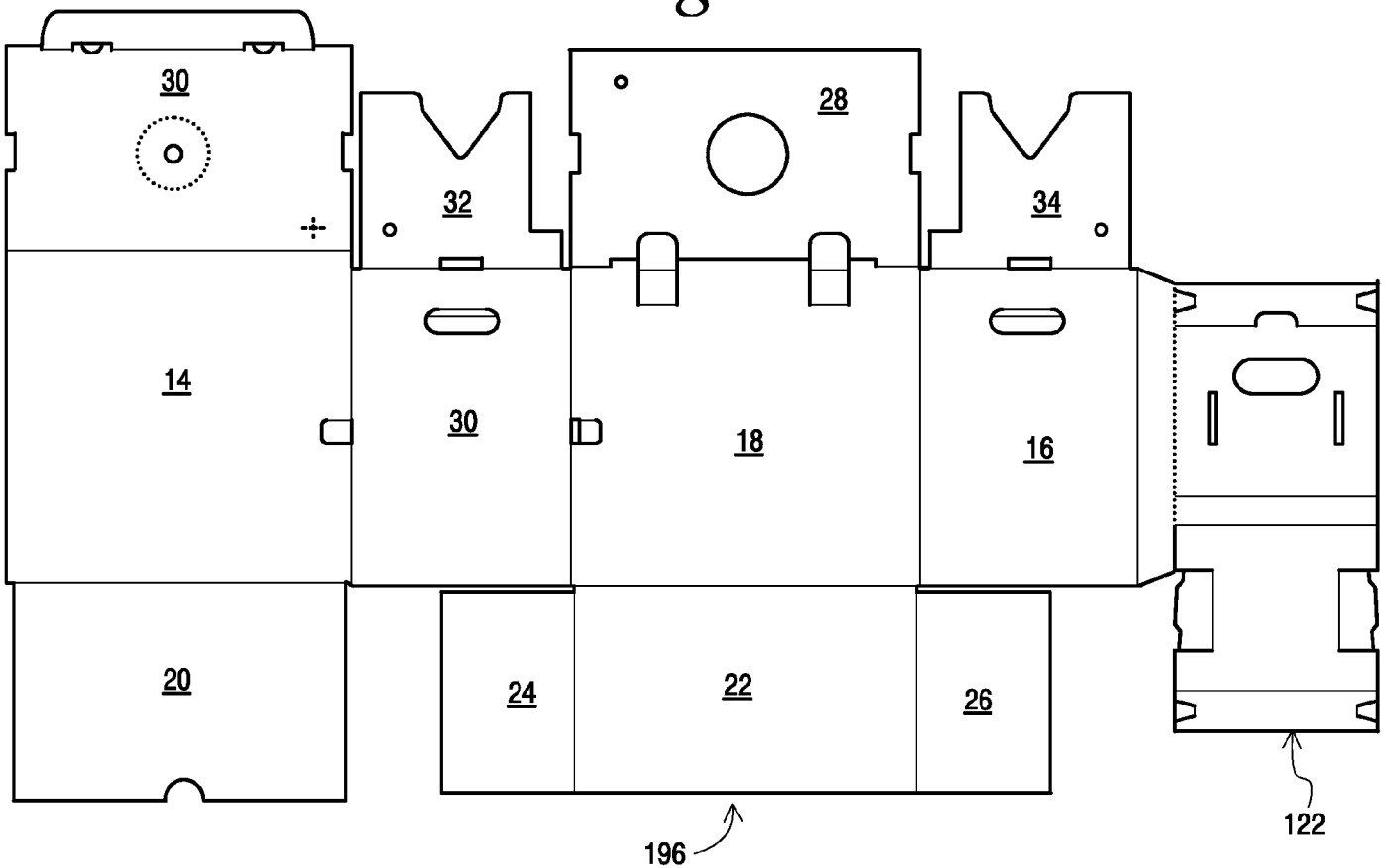
FIG. 28 is a plan view of a further alternate embodiment of a carton blank, which is generally similar in layout to FIG. 1 embodiment except that it has a single hand hole and a single adapter.

Next the coil of filamentary material is placed in the carton. Following that the first adapter 122 is installed through the open front of the carton, sliding in between the side panels 14, 18. The mating plate 128 is placed in contact with the underside of the top panel. Because the front panels are still open the tongue 132 cannot yet support the first adapter. Instead, the installer closes the first retention members 80 by pushing them into the carton where they engage the underside of the mating plate 128 as shown in the detail of FIG. 28. The first retention members 80 hold the first adapter in place with the secondary hand hole 130 aligned with the first primary hand hole 62 and the mating plate 128 fully surrounding the rim 66 and reinforcing the entirety of the grasping zone of the first primary hand hole 62.

Figure 12:
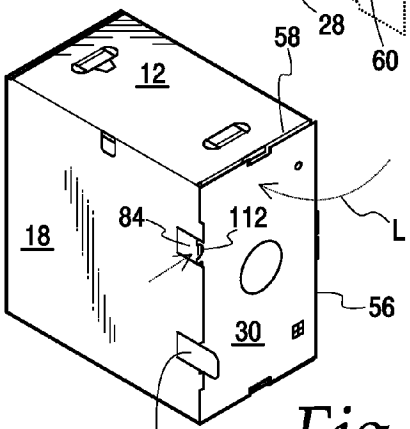
FIG. 12 is a perspective view similar to FIG. 11, showing the final steps for closing the front end, namely, closing the front exterior or shielding panel and tucking in the retainer tabs.
Figure 9:
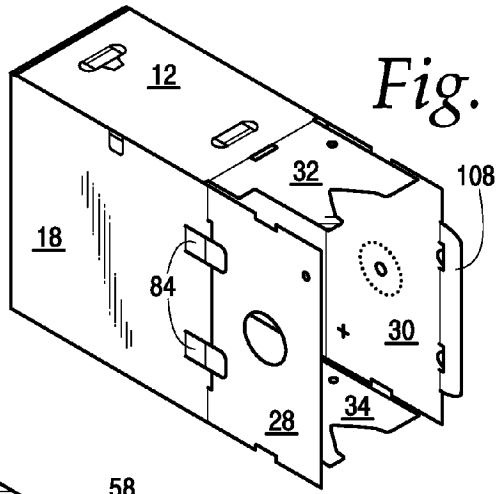
FIG. 9 is a perspective view of the partially assembled carton, with the rear of the box fully assembled and the fully open front of the box in the foreground.
Figure 11:
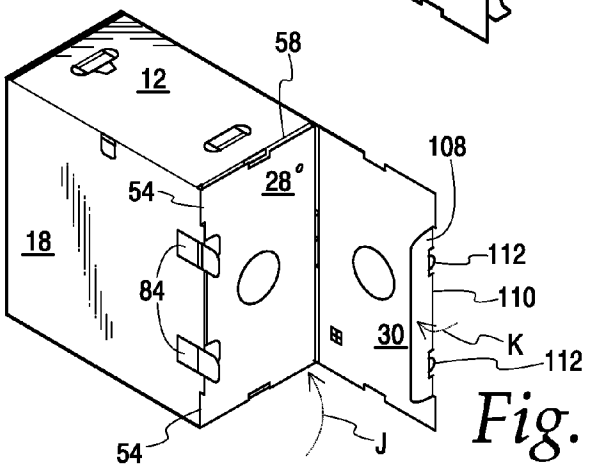
FIG. 11 is a perspective view similar to FIG. 10, showing the next step for closing the front end, namely, closing the front interior panel.

After both adapters and the wire coil are installed the front of the carton is closed. First, the upper and lower V-notch flaps 32, 34 are folded down and up, respectively, about fold lines 58 and 60, as shown by arrows H and I in FIG. 10, and a payout tube (not shown) is placed in the V-notches 114. Second, the front interior panel 28 is folded in about hinges 54. Third, retainer flap 108 is prepared by folding it about fold line 110, as shown by arrow K in FIG. 11. Fourth, front exterior panel 30 is folded in about fold line 56, as shown by arrow L in FIG. 12. As panel 30 closes the retainer flap 108 is tucked into retainer slit 88 between left side panel 18 and front interior panel 28. Finally, the retainer tabs 84 are folded and tucked into retainer slots 112 in the front exterior panel 30. In FIG. 12 the top tab 84 is shown tucked in and the bottom tab awaits being tucked in.

As noted above, installation of the adapters is made possible by the fact that the adapters are narrower than the space between the side panels. No attachment elements protrude from the sides of the adapters that would interfere with sliding them in between the side panels. Instead, the retention elements are in the carton itself and these are pushed into the interior of the carton after placement of the adapters. The retention members hold the adapters in place. It is further pointed out that the second adapter could be installed at any of the second primary hand holes, either on the top panel or on the bottom panel. Thus, there are multiple possible destinations for the second adapter. Testing of the hand hole strength with the first adapter on the top panel and the second adapter on the bottom panel has been conducted in accordance with ASTM 6804-02 (2007), Tensile Test, method B-section X.1.1.2. The average peak load under this test is about 257 pounds.

Figure 20:
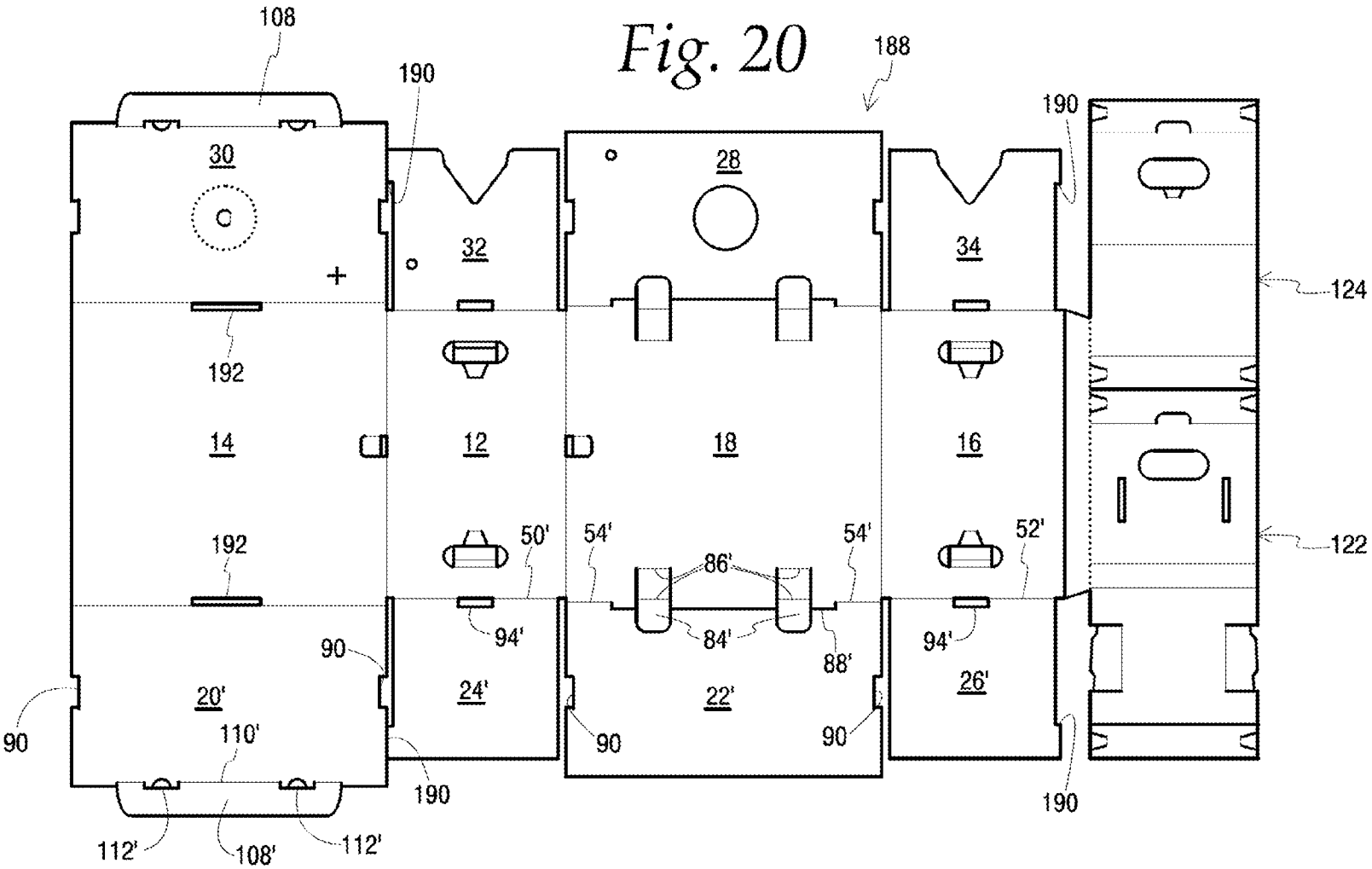
FIG. 20 is a plan view of an alternate embodiment of a carton blank, which also includes a portion defining first and second adapter blanks, all shown as one unit.
Figure 22:
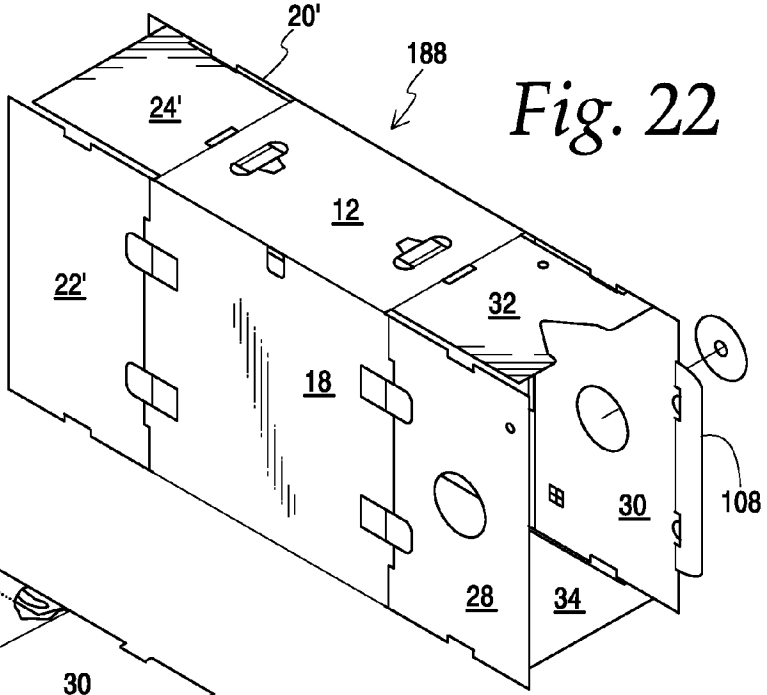
FIG. 22 is a perspective view of the setup carton of FIG. 21, ready for assembly, with the front of the carton in the foreground.
Figure 21:
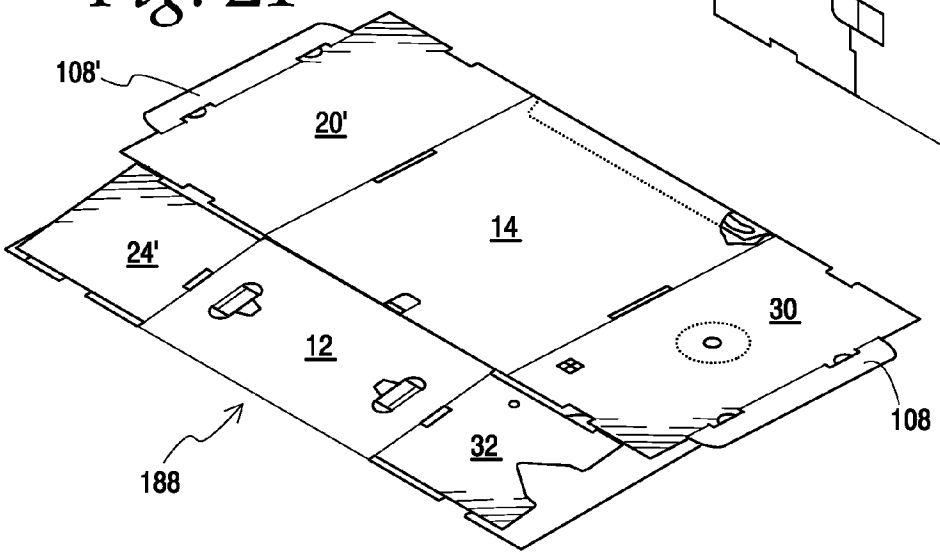
FIG. 21 is a perspective view of the knocked-down carton blank of FIG. 20 after being folded and glued, with the adapter blanks removed, ready for setup and assembly.
Figure 24:
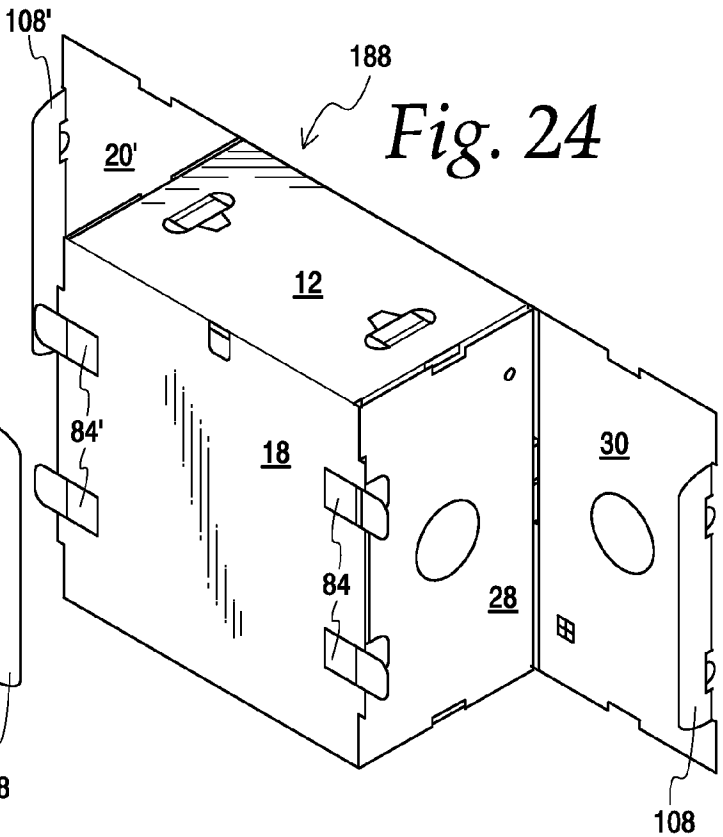
Figure 23:
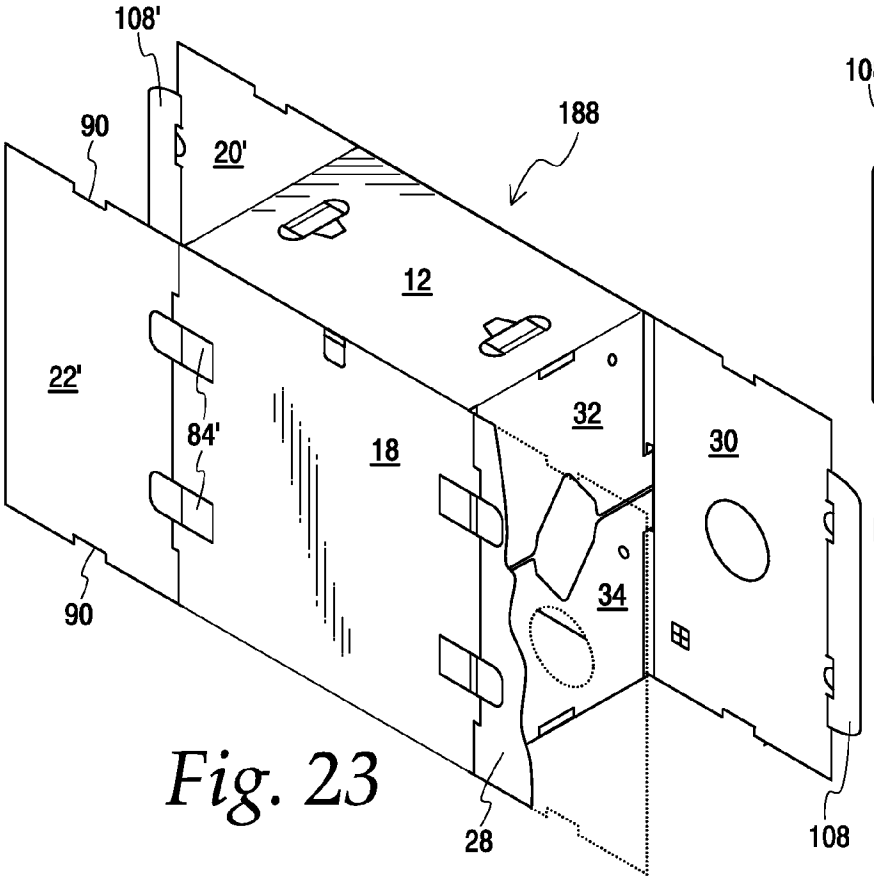

FIGS. 20-26 illustrate an alternate embodiment of the carton at 188. A blank for this carton is shown in FIG. 20. Carton 188 is the same in many respects as carton 10. The adapters are identical. Thus, like parts will be given the same reference numeral as in the previous embodiment and their description will not be repeated. Parts that are changed will be designated with a single prime mark. The major difference between the two cartons is the turkey tail at the rear closure of carton 10 is replaced with a closure that is the same as the front closure. This affords some flexibility in loading the carton as either the front or rear can be closed first, whereas the turkey tail must be closed before the front closure.

The rear closure of carton 188 includes rear interior panel 22' which is attached to left side panel 18 at hinges 54'. The left side panel also has two retainer tabs 84' defined by a U-shaped slit. Each retainer tab has two fold lines 86' that allow the tabs to be tucked into the rear exterior panel 20'. Extending between the retainer tabs 84', and slightly beyond them, is a retainer flap slit 88'. This receives a retainer flap on the rear exterior panel 20'. The turkey tail flaps are replaced by rear interior flaps 24', 26'. These are attached at fold lines 50', 52' to the top panel 12 and bottom panel 16, respectively. Each rear interior flap 24', 26' includes a tongue slot 94' on its fold line and a tab 190 at an outer corner. The rear exterior panel 20' has tongue notches 90 and a retainer flap 108' attached at fold line 110'. Retainer slots 112' interrupt the fold line 110'.

The remainder of the carton 188 is similar to carton 10 except that the V-notch flaps 32, 34 include tabs 190 on an outer corner similar to tabs 190 on the rear interior flaps 24', 26'. These tabs 190 fit into slots 192 formed in the fold lines of the right side panel 14 to help retain the front and rear flaps in their closed positions.

Figure 26:
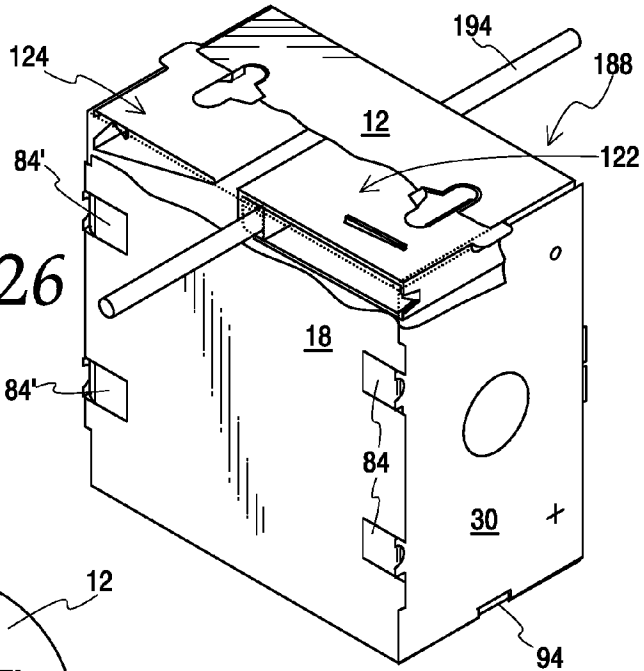
FIG. 26 is a perspective view of the fully assembled carton of FIG. 20, with portions broken away to show the first and second adapters mounted therein and with a carton-mounting shaft extending through the carton and first adapter.
Figure 27:
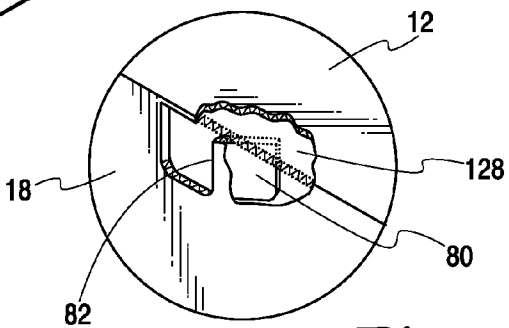
FIG. 27 is an enlarged perspective view of the first retention member engaging the first adaptor's mating plate.
Figure 25:
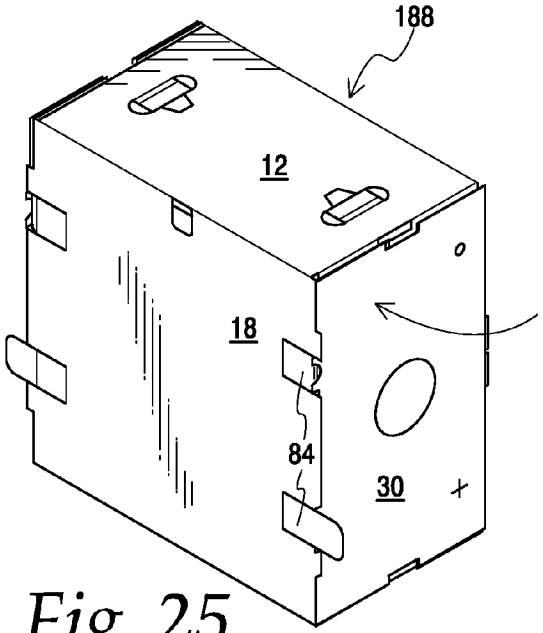

FIGS. 21-25 illustrate the assembly procedure for carton 188. It is essentially the same as that described above except the procedure for closing the front is used at both the front and rear in carton 188. FIG. 26 shows the completed carton, with portions broken away to illustrate placement of the first and second adapters 122, 124 against the interior surface of the top panel 12. FIG. 26 also shows a mounting shaft 194 extending through the side panels and the first adapter 122. As more fully described in the above patent application, the shaft is used to mount the carton on an electrician's cart. The first adapter reinforces the top panel to prevent the mounting shaft 194 from tearing out of the top panel.

FIG. 28 illustrates yet another embodiment of a carton at 196. This carton is similar in most respects to carton 10 except that it has only a single adapter 122 and only a single primary hand hole 62 on the top panel 12 and a single second primary hand hole 64 on the bottom panel. The width of the top and bottom panels is larger than the width of the adapter 122 so the side panels 14, 18 are spaced far enough apart to permit the adapter to slide into position through the open front end of the carton. The adapter is held in place by the first retention members 80 as described above.

While the preferred form of the invention has been shown and described herein, it should be realized that there may be many modifications, substitutions and alterations thereto. For example, while the adapter mating plates are shown fully surrounding the primary hand holes and reinforcing all of the grasping zone, it could be otherwise. That is, an adapter's mating plate may lie adjacent only a portion of the area around the primary hand hole in which case only the reinforced portion would be considered a suitable lifting location. In this case a user would be expected not to lift at an unreinforced portion of the panel.

Retention members could have alternate configurations from the inwardly-extending tabs shown. For example, the retention member could be a patch of adhesive on the interior surfaces of the panels, preferably with a removable release liner. Or the retention member could be a hook-and-loop connector (e.g., Velcro®) on the interior surfaces of the panels. A still further alternate form of retention member could be a separate screw-like fastener inserted through the panel and into the adapter.

While the carton is shown having six, fully-enclosed sides, it could be otherwise. Fewer than six sides could be used if desired. Or one or more of the panels could be shortened so a portion of a side could be partially open. Also, while the carton has been described with regard to use with a wire coil, the carton could be used with other types of filamentary materials, such as rope.

I claim:

1. A carton, comprising:

a plurality of panels including at least one lifting panel, a front panel, a rear panel, a bottom panel and two facing side panels, each side panel adjoining the lifting panel, at least one of the front, rear, side and bottom panels being an alternate lifting panel, each panel having interior and exterior surfaces, the panels collectively defining an interior space for receiving articles to be contained in the carton;

a first primary hand hole formed in the lifting panel and a second primary hand hole formed in one of the lifting panel and the alternate lifting panel, each primary hand hole defining in its panel a rim and a grasping zone adjacent the hand hole, the grasping zone being opposite a user's fingers extending through the primary hand hole into the interior space and wrapping about the rim of the primary hand hole to face the interior surface of the panel in which the primary hand hole is formed;

first and second adapters for reinforcing at least a portion of the grasping zone adjacent the first and second primary hand holes, respectively, each of the adapters having a mating plate which when the adapter is installed extends in a plane parallel to the interior surface of the panel in which the primary hand hole is formed and is adjacent at least a portion of the grasping zone of said primary hand hole;

at least one first retention member supported by each of said side panels adjacent the lifting panel and engageable with the first adapter to support it adjacent the first primary hand hole; and at least one second retention member supported by at least one of said plurality of panels and engageable with the second adapter to support it adjacent the second primary hand hole.

2. The carton of claim 1 wherein the lifting panel is bounded by edges on opposite sides thereof and the first adapter is sized to fit between said edges.

3. The carton of claim 1 wherein the alternate lifting panel is bounded by edges on opposite sides thereof and the second adapter is sized to fit between said edges.

4. The carton of claim 1 wherein the first adapter further comprises a secondary hand hole formed in the mating plate and which when installed is generally aligned with the associated primary hand hole.

5. The carton of claim 1 wherein the second adapter further comprises a secondary hand hole formed in the mating plate and which when installed is generally aligned with the associated primary hand hole.

6. The carton of claim 1 wherein the first adapter further comprises at least one gusset plate engageable with the mating plate and extending out of the plane of the mating plate to reinforce the mating plate.

7. The carton of claim 1 wherein the second adapter further comprises at least one gusset plate engageable with the mating plate and extending out of the plane of the mating plate to reinforce the mating plate.

8. The carton of claim 1 wherein the first retention member is formed in one of the panels and is extendable into the interior space of the carton.

9. The carton of claim 1 wherein the second retention member is formed in one of the panels and is extendable into the interior space of the carton.

10. The carton of claim 1 wherein at least one of the first and second retention members is extendable into the interior space of the carton.

11. A carton, comprising:

a plurality of panels including at least one lifting panel, and at least one alternate lifting panel, each panel having interior and exterior surfaces, the panels collectively defining an interior space for receiving articles to be contained in the carton;

a first primary hand hole formed in the lifting panel, a second primary hand hole formed in one of the lifting panel and the alternate lifting panel, and a third primary hand hole formed in the alternate lifting panel, each primary hand hole defining in its panel a rim and a grasping zone adjacent the hand hole, the grasping zone being opposite a user's fingers extending through the primary hand hole into the interior space and wrapping about the rim of the primary hand hole to face the interior surface of the panel in which the primary hand hole is formed;

first and second adapters removably insertable into the interior space of the carton, each adaptor being selectably engageable with the panels for reinforcing at least a portion of the grasping zone adjacent a single one of the primary hand holes, each of the adapters having a mating plate which when the adapter is installed extends in a plane parallel to the interior surface of the panel in which the primary hand hole is formed and is adjacent at least a portion of the grasping zone of said primary hand hole, the second adapter being selectably engageable with a primary hand hole formed in either the lifting panel or the alternate lifting panel.

12. The carton of claim 11 further comprising:

at least one first retention member formed in one of the panels and extendable into the interior space where it is engageable with the first adapter to support it adjacent the first primary hand hole; and at least one second retention member formed in one of the panels and extendable into the interior space where it is engageable with the second adapter to support it adjacent one of the second and third primary hand holes.

13. The carton of claim 11 wherein the first and second adapters are each connected to at least one of the panel of its associated primary hand hole and the panels adjacent thereto; and the first and second adapters are spaced from the opposite panel parallel to the panel of its associated primary hand hole such that when the carton is oriented with the panel of the associated hand hole being the uppermost panel, the adapters are suspended above said the opposite panel without contacting said opposite panel.

14. The carton of claim 11 wherein the alternate lifting panel is bounded by edges on opposite sides thereof and the second adapter is sized to fit between said edges.

15. The carton of claim 11 wherein the first adapter further comprises a secondary hand hole formed in the mating plate and which when installed is generally aligned with the associated primary hand hole.

16. The carton of claim 11 wherein the second adapter further comprises a secondary hand hole formed in the mating plate and which when installed is generally aligned with the associated primary hand hole.

17. The carton of claim 11 wherein the first adapter further comprises at least one gusset plate engageable with the mating plate and extending out of the plane of the mating plate to reinforce the mating plate.

18. The carton of claim 11 wherein the second adapter further comprises at least one gusset plate engageable with the mating plate and extending out of the plane of the mating plate to reinforce the mating plate.

19. A carton, comprising:

a plurality of panels including at least one lifting panel, at least one alternate lifting panel parallel to the lifting panel and spaced therefrom, a pair of side panels joining the lifting panels, each panel having interior and exterior surfaces, the panels collectively defining an interior space for receiving articles to be contained in the carton;

a first primary hand hole formed in the lifting panel and defining in the lifting panel a rim and a grasping zone adjacent the hand hole, the grasping zone being opposite a user's fingers extending through the primary hand hole into the interior space and wrapping about the rim of the primary hand hole to face the interior surface of the panel in which the primary hand hole is formed; and a first adapter for reinforcing at least a portion of the grasping zone adjacent the first primary hand hole, the first adapter having a mating plate which when the adapter is installed extends in a plane parallel to the interior surface of the lifting panel and is adjacent at least a portion of the grasping zone of said primary hand hole, the first adapter having a maximum width less than the distance between the side panels, and;

at least one first retention member mounted on one of the side panels and selectably engageable with an installed first adapter to retain the first adapter in engagement with the lifting panel such that both the first retention member and the first adapter are spaced from the alternate lifting panel.

20. The carton of claim 19 further comprising:

a second primary hand hole formed in one of the lifting panel and the alternate lifting panel, the second primary hand hole defining in its panel a rim and a grasping zone adjacent the hand hole, the grasping zone being opposite a user's fingers extending through the primary hand hole into the interior space and wrapping about the rim of the primary hand hole to face the interior surface of the panel in which the primary hand hole is formed; and a second adapter for reinforcing at least a portion of the grasping zone adjacent the second primary hand hole, the second adapter having a mating plate which when the adapter is installed extends in a plane parallel to the interior surface of said one of the lifting panel and the alternate lifting panel and is adjacent at least a portion of the grasping zone of the second primary hand hole, the second adapter having a maximum width less than the distance between the side panels.

21. The carton of claim 19 wherein the first adapter further comprises a secondary hand hole formed in the mating plate and which when installed is generally aligned with the associated primary hand hole.

22. The carton of claim 20 wherein the second adapter further comprises a secondary hand hole formed in the mating plate and which when installed is generally aligned with the associated primary hand hole.

23. The carton of claim 19 wherein the first adapter further comprises at least one gusset plate connected to the mating plate and extending out of the plane of the mating plate to reinforce the mating plate.

24. The carton of claim 20 wherein the second adapter further comprises at least one gusset plate connected to the mating plate and extending out of the plane of the mating plate to reinforce the mating plate.

25. The carton of claim 19 further comprising at least one first retention member formed in one of the panels and extendable into the interior space where it is engageable with the first adapter to support it adjacent the first primary hand hole.

26. The carton of claim 20 further comprising at least one second retention member formed in one of the panels and extendable into the interior space where it is engageable with the second adapter to support it adjacent the second primary hand holes.

* * * * *